US006152715A

United States Patent [19]

Kaempe et al.

[11] Patent Number: 6,152,715

[45] Date of Patent: Nov. 28, 2000

[54] PRESSURE CLAMPED HYDRAULIC PUMP

[76] Inventors: Staffan I. Kaempe, 2209 Highway 150E., Paoli, Ind. 47454; Dennis G. Ewald, 15950 E. Big Mound Rd., Lindenwood, Ill. 61049

[21] Appl. No.: 09/016,404

[22] Filed: Jan. 30, 1998

[51] Int. Cl.[7] ..... F04C 2/00

[52] U.S. Cl. ..... 418/132; 418/133; 418/149; 418/206.1; 60/477; 60/481

[58] Field of Search ..... 418/132, 133, 418/149, 70, 206.1; 60/477, 481

[56] References Cited

U.S. PATENT DOCUMENTS

| | | | |
|---|---|---|---|
| 2,161,729 | 6/1939 | Thomson | 418/132 |
| 2,472,031 | 5/1949 | Wichorek | 418/149 |
| 2,965,040 | 12/1960 | Eisenberg | 418/149 |
| 3,213,799 | 10/1965 | Trick | 418/132 |
| 3,240,158 | 3/1966 | Brundage . | |
| 3,385,217 | 5/1968 | Bles | 60/477 |
| 3,416,459 | 12/1968 | Reimer et al. | 418/132 |
| 3,855,791 | 12/1974 | Quinto | 60/477 |
| 4,373,871 | 2/1983 | Christ . | |
| 4,443,168 | 4/1984 | Dworak | 418/206.1 |
| 4,551,973 | 11/1985 | Broadhead | 60/477 |
| 4,830,592 | 5/1989 | Weidhaas . | |
| 5,577,899 | 11/1996 | Phillips . | |

FOREIGN PATENT DOCUMENTS

| | | |
|---|---|---|
| 706979 | 4/1902 | United Kingdom . |

*Primary Examiner*—Thomas Denion
*Assistant Examiner*—Thai-Ba Trieu

[57] ABSTRACT

A pump assembly comprises a hydraulic fluid pump having a housing assembled from a plurality of housing components that are pinned together rather than being clamped together by bolts. The pump is disposed in a cavity in a valve block so that the outlet fluid pressure from the pump is applied axially to the housing components to create a greater external axial force on the pump components than the internal axial force and thereby maintain the housing components in tight, sealing relation without the need for clamping bolts or other clamping means.

21 Claims, 2 Drawing Sheets

PRESSURE CLAMPED HYDRAULIC PUMP

FIELD OF THE INVENTION

The present invention relates to hydraulic pumps and more particularly to a cavity-mounted hydraulic pump in which the components are clamped together by the fluid output pressure of the pump so that no bolts or other fasteners are necessary to hold the components together in a fluid-tight manner.

BACKGROUND OF THE INVENTION

Conventional hydraulic pumps of the type that are fitted into a cavity in a valve block or cylinder head, for example, are typically constructed of a number of pump components which are clamped or otherwise fastened together by a plurality of bolts or other types of fasteners. In one application, such hydraulic pumps are mounted in a valve block and are used to supply hydraulic pressure selectively to one or a plurality of hydraulic cylinders or jacks. One of the problems associated with the conventional hydraulic pumps used for that purpose, as well as for other purposes, is the difficulty of reducing the size, cost and weight of the hydraulic pump below a certain minimum for the required hydraulic output pressure and volumetric flow output. Heretofore, the need to hold the pump components together with fasteners, such as bolts, to prevent leakage, for instance, has made it difficult to miniaturize this type of pump below a certain minimum size and weight.

It would be desirable, therefore, to provide a hydraulic pump that can be securely held together without the use of fasteners, such as bolts, so as to minimize the size, weight and cost of the pump, yet that would still be provided with the clamping force necessary to hold the pump components together in a leak-tight manner.

SUMMARY OF THE INVENTION

The present invention is directed to an improved, pressure-clamped hydraulic pump that is characterized by low cost, and a small size and weight for given parameters of pump output pressure and volumetric flow rate. The hydraulic pump of the invention is described as a gear-type pump, but it should be understood that the principles of the invention can be applied to other types of positive displacement pumps, such as pistontype, vane-type, rotor-type pumps or the like.

The hydraulic pump of the invention is designed to be threadably inserted into an internally threaded cavity, such as in a valve block or cylinder head. When the pump is threaded into the cavity and tightened, the pump components are clamped together between the bottom of the cavity and the threads. The pump outlet discharges into the cavity. Because of a differential area between the internal and external pump components that are exposed to the outlet pressure of the pump, the external force on the pump components owing to the outlet pressure exceeds the internal force on the pump components so that there is a net force of fluid pressure that clamps the pump components together. Thus, as the pump output pressure increases, the external clamping force on the pump increases making the pump more and more leak-tight.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE INVENTION

Figure 1:
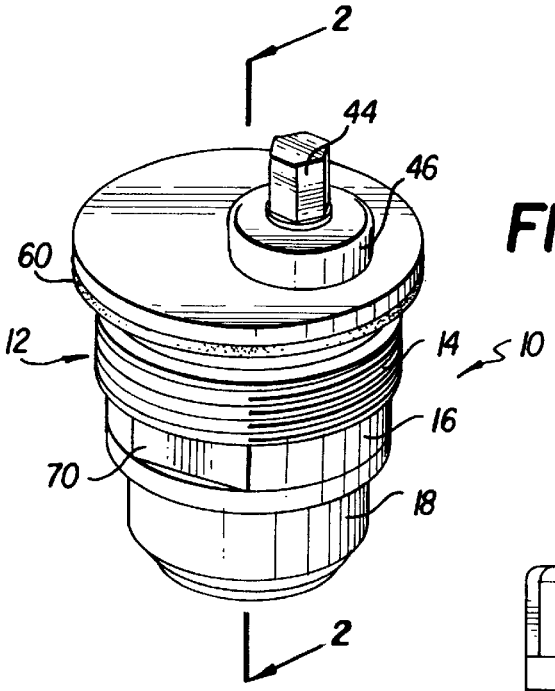
FIG. 1 is a perspective view of the pressure clamped hydraulic pump of the present invention.

Reference will now be made in detail to the preferred embodiment of the invention illustrated in the accompanying drawings, wherein like parts are designated by like numerals throughout. FIGS. 1–4 illustrate an exemplary embodiment of the hydraulic pump of the invention which is designated generally by reference numeral 10.

Figure 2:
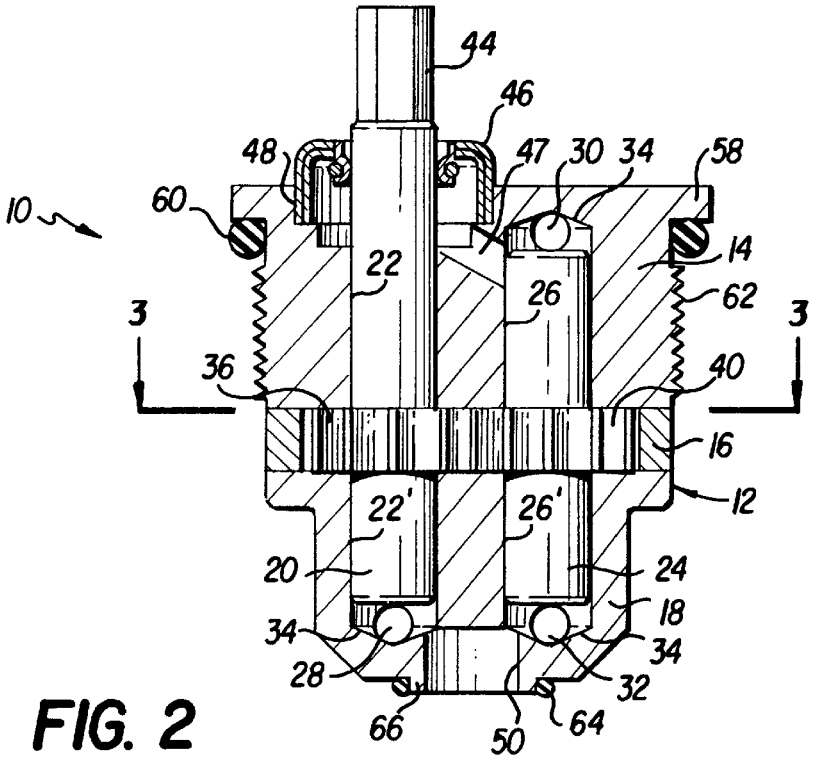
FIG. 2 is a cross-sectional view of the hydraulic pump of the present invention taken along line 2—2 of FIG. 1.

Referring to FIGS. 1–2, the pump 10 comprises a housing 12 made up of three components, a top or front cover 14, a gear housing 16, and a bottom or rear cover 18. A drive shaft 20 is rotatably mounted in bores 22, 22' in the front and rear covers, respectively. An idler shaft 24 is similarly rotatably mounted in bores 26, 26' in the front and rear covers, respectively. Balls 28, 30, 32 located in conical recesses 34 in the ends of the bores 22, 26, 26' axially support the shafts 20, 24 in the housing 12 for rotation and absorb the thrust forces of the shafts in a low friction manner. Although the components of the pump are preferably made of metal materials, it is contemplated within the scope of the invention that some or all of the pump components can be made of polymeric or other synthetic materials.

Figure 3:
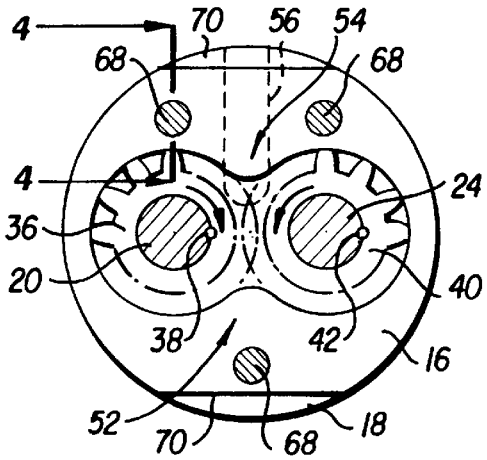
FIG. 3 is a transverse cross-sectional view of the hydraulic pump of the invention taken along line 3—3 of FIG. 2.

In the described embodiment, the pump 10 is a gear pump comprising a primary or driven pump gear 36 keyed to drive shaft 20 by a key 38 (FIG. 3) and a secondary or idler pump gear 40 meshed with pump gear 36 and keyed to idler shaft 24 by a key 42 (FIG. 3). Drive shaft 20 is provided with an hexagonal drive connection 44 at the upper end thereof and shaft 20 extends through a seal 46 mounted in a cylindrical recess 48 in the front cover 14 of the housing 12.

The rear cover 18 is provided with an axial inlet port 50 which directs hydraulic fluid to the inlet side 52 (FIG. 3) of the primary and secondary gears 36, 40. As the gears 36, 40 rotate in the direction shown by the arrows in FIG. 3, hydraulic fluid is pumped from the inlet side 52 to the outlet side 54 of the gears and out a radial outlet port 56 in said rear cover 18 shown in FIG. 5 and in dashed lines in FIG. 3.

Front cover 14 is has an annular flange 58 at the top thereof for retaining an O-ring seal 60 and is provided with an external thread 62. Another O-ring seal 64 is mounted on a shoulder 66 of the rear cover 18. The purpose of the seals 60, 64 and thread 62 will be described hereinafter in connection with FIG. 2.

Figure 4:
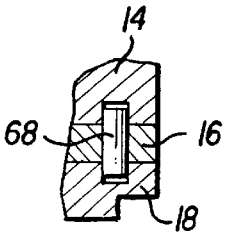
FIG. 4 is a fragmentary cross-sectional detail taken along line 4—4 of FIG. 3.
Figure 5:
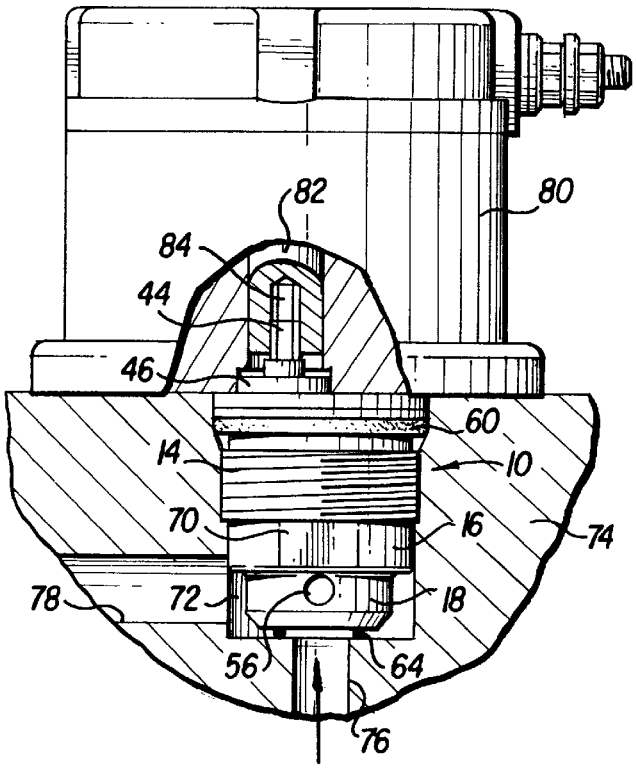
FIG. 5 is a fragmentary side elevation view, partly in cross-section, showing the hydraulic pump of the invention mounted in a valve block and connected to a drive motor.

Referring to FIGS. 4 and 5, the front cover 14, gear housing 16 and rear cover 18 are located with respect to one another by means of dowel pins 68. The number and location of the dowel pins 68 is such that the components will fit together in only one orientation, and two or more pins may be used. Flats 70 are formed on the periphery of the gear housing 16 to aid in locating the positions of the dowel pins 68. It will be understood that locating means other than dowel pins may be used to register the three components of the housing 12. For example, mating protrusions and recesses may be formed in the confronting surfaces of the front and rear covers and gear housing to provide for proper registration of the housing components.

Most of the pressurized hydraulic fluid from the high pressure outlet side 54 of the pump 10 passes through the outlet port 56. Any fluid leakage from the outlet side 54 passes to the low pressure or inlet side 52 of the pump 10 which communicates with the seal 46 and bores 22, 22', 26, 26' via a channel 47 (FIG. 2).

Now referring to FIG. 5, the pump 10 is shown installed in a cylindrical cavity or bore 72 in a typical valve block 74. Cavity 72 is internally threaded to receive the threads 62 of the front cover 14. An inlet channel 76 in the valve block 74 communicates with the bottom of the cavity 72 and an outlet channel 78 in the valve block 74 communicates with a sidewall of the cavity. The pump 10 is installed in the cavity 72 by threading the threads 62 into the cavity until the O-ring seals 60 and 64 seal the cavity 72 and the inlet channel 76, respectively. O-ring 64 seals and separates the low pressure inlet channel 76 from the high pressure portion of the cavity 72 including the outlet channel 78.

Threading of the pump 10 into the cavity 72 compresses the O-ring seals 60 and 64 and holds the pump parts securely together. When the pump 10 is operated, the internal pressure in the pump increases which tends to separate the front cover, gear housing and rear cover from one another. In conventional pumps, such separation is typically prevented by clamping bolts which pass through the pump components from top to bottom. In the pump according to the invention, no clamping bolts are used. Rather, the high pressure hydraulic fluid which has been pumped through the pump outlet 56 into the cavity 72 envelopes the lower end of the pump 10 and applies an axial fluid pressure or force thereto which forces the rear cover 18 into a tighter sealing contact with the gear housing 16 and front cover 14.

The external axial area of the pump on which the pressurized fluid acts is equal to the cavity cross-sectional area less the cross-sectional area enclosed by the O-ring seal 64. The internal axial area on which the high pressure fluid acts is, at most, equal to the axial area of the gear teeth between the roots and tips of the gears. Thus, the internal axial area is substantially less than the external axial area with the result that the pump components are clamped together by the force of the pumped fluid acting on the external axial area of the rear cover 18. Such force, of course, increases as the pump output pressure increases. This clamping force makes it possible to eliminate any clamping bolts or clamping fasteners for the pump.

The pump 10 is driven by a suitable drive motor 80 which is mounted to the valve block 74. The drive motor 80 has a motor drive shaft 82 with an axial blind bore 84 having a hexagonal cross-section which mates with the hexagonal drive connection 44 at the end of shaft 20 of the pump 10. Motor 80 may be any suitable type of motor, such as electric, pneumatic, or other rotational drive force.

Figure 6:
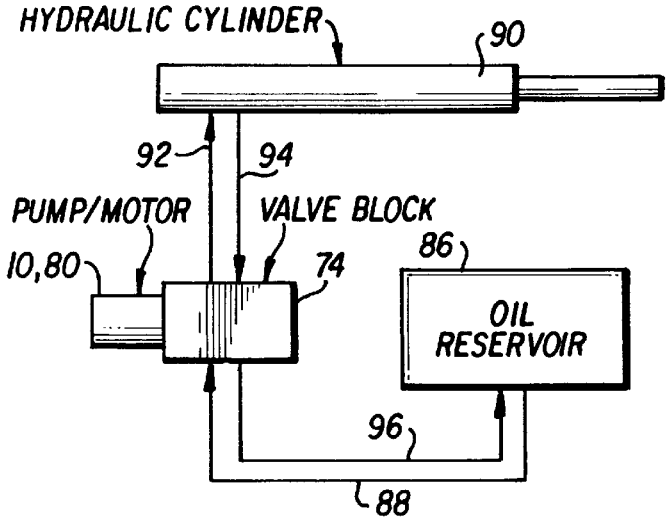
FIG. 6 is a schematic illustration of a system for using the hydraulic pump of the present invention.

FIG. 6 illustrates in schematic form one of many possible applications for the hydraulic pump of the present invention. In this application, hydraulic fluid is supplied from an oil reservoir 86 to the valve block 74 via a line 88 where it is drawn into the inlet of pump 10 and pumped under pressure to a hydraulic cylinder 90 via a line 92. Fluid may be exhausted to the oil reservoir via lines 94, 96 and valve block 74 by conventional valving means which forms no part of the present invention.

From the foregoing, it will be appreciated by those skilled in the art that the present invention provides a unique, low cost and small size hydraulic pump useful in many applications.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A pump for pumping a fluid comprising a housing having an axis, said housing including a plurality of pump components positioned in axially disposed relation to one another, an inlet and an outlet in said housing, pumping means located in said housing for drawing fluid into said inlet at a first pressure and pumping said fluid from said outlet at a second pressure greater than said first pressure, and means for applying the second pressure to at least some of said pump components to hold said plurality of pump components together in said axially disposed relation without applying a separate clamping force to said components in a direction parallel to said housing axis.

2. The pump of claim 1, wherein said pump components comprise a front cover, a rear cover and a gear housing disposed between said front and rear covers.

3. The pump of claim 2, wherein said pumping means comprises a gear pump having primary and secondary gears meshed with one another.

4. The pump of claim 3, including drive and idler shafts rotatably supported in bores in said front and rear covers, said primary gear being fixed to said drive shaft and said secondary gear being fixed to said idler shaft, said primary and secondary gears being disposed in said gear housing between said front and rear covers.

5. The pump of claim 4, wherein said idler shaft has two ends and is rotatably supported in said bores by a ball disposed at each end of said idler shaft.

6. The pump of claim 4, wherein one end of said drive shaft extends through said front cover, said one end having a drive connection and a seal means at said one end for sealing said drive shaft at said front cover.

7. The pump of claim 2, wherein said housing has a first axial area internally of said housing and said second pressure acts upon said first axial area, said rear cover having a second axial area externally of said rear cover greater than said first axial area.

8. The pump of claim 2, wherein said inlet comprises an axial opening in said rear cover and said outlet comprises a radial passage in said rear cover.

9. The pump of claim 1, wherein said holding means comprises a plurality of pins extending through holes in said components.

10. The pump of claim 1, wherein said housing includes an external thread for threadably securing said pump in a cavity.

11. A pump assembly for pumping a fluid comprising:

a pump, said pump comprising a housing having an axis, said housing including a plurality of pump components positioned in axially disposed relation to one another, an inlet and an outlet in said housing, pumping means located in said housing for drawing fluid into said inlet at a first pressure and pumping said fluid from said outlet at a second pressure greater than said first pressure, said housing having a first internal axial area upon which said second pressure acts and a second external axial area greater than said first axial area;

a motor connected to said pump for driving the pumping means;

a block having a cavity, said pump being mounted in said cavity, said block having an inlet channel communicating with said cavity and the pump inlet and an outlet channel communicating with said cavity and the pump outlet, and means for sealing said pump inlet and the inlet channel from said pump outlet and the outlet channel such that said second pressure acts upon said second axial area when said pump is operated and applies a clamping force to said housing components.

12. The pump assembly of claim 11, wherein said pump components comprise a front cover, a rear cover and a pumping means housing disposed between said front and rear covers.

13. The pump assembly of claim 12, wherein the front cover of said pump has an external thread and said cavity has an internal thread, the external thread of the front cover being threadably engaged with the internal thread of said cavity.

14. The pump assembly of claim 13, wherein said sealing means comprises an O-ring seal mounted on said rear cover around said pump inlet and further including an O-ring seal mounted on said front cover for sealing said pump in said cavity.

15. The pump assembly of claim 12, including drive and idler shafts rotatably supported in bores in said front and rear covers, a primary gear fixed to said drive shaft and a secondary gear fixed to said idler shaft, said primary and secondary gears being disposed in said pumping means housing between said front and rear covers.

16. The pump assembly of claim 15, wherein said idler shaft has two ends and is rotatably supported in said bores by a ball disposed at each end of said idler shaft, said drive shaft having two ends and is rotatably supported at one end by a ball, and a drive connection at the other end of said drive shaft.

17. The pump assembly of claim 12, wherein said pump inlet comprises an axial opening in said rear cover and said pump outlet comprises a radial passage in said rear cover.

18. The pump assembly of claim 11, wherein said block is a valve block and said pump supplies pressurized hydraulic fluid to a hydraulic cylinder.

19. The pump assembly of claim 11, including means for holding said plurality of housing components together in axially disposed relation without applying a clamping force to said components in a direction parallel to said housing axis.

20. The pump assembly of claim 19, wherein said holding means comprises a plurality of pins extending through holes in said components.

21. A pump for pumping a fluid comprising a pump housing having an axis and a plurality of pump components, including a front cover, a gear housing and a rear cover, said pump components being positioned in axially disposed relation to one another, an inlet and an outlet in said rear cover, pumping means located in said gear housing for drawing fluid into said inlet at a first pressure and pumping said fluid from said outlet at a second pressure greater than said first pressure, and means for applying the second pressure to at least some of said pump components to hold said front cover, gear housing and rear cover together in said axially disposed relation without applying a separate clamping force to said components in a direction parallel to said housing axis.

* * * * *